US006234621B1

(12) United States Patent
Musser et al.

(10) Patent No.: US 6,234,621 B1
(45) Date of Patent: May 22, 2001

(54) FOAMLESS RAMPS FOR CONTROLLING THE FLOW OF INK TO ELIMINATE FOAM IN AN INK TANK

(75) Inventors: Marshall R. Musser, Granger, IN (US); Bruce W. Gamble, Fairborn, OK (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/211,015

(22) Filed: Dec. 14, 1998

(51) Int. Cl.[7] ..... B41J 2/19; B41J 2/18; B41J 2/175

(52) U.S. Cl. ..... 347/92; 347/89; 347/96

(58) Field of Search ..... 347/92, 89, 86, 347/85, 90; 210/188; 95/261; 96/208, 216

(56) References Cited

U.S. PATENT DOCUMENTS

| | | | | |
|---|---|---|---|---|
| 1,863,111 | * | 6/1932 | Greve | 96/216 |
| 4,023,182 | * | 5/1977 | Arway et al. | 347/90 |
| 4,199,332 | * | 4/1980 | Krohn et al. | 96/208 |
| 4,301,459 | * | 11/1981 | Isayama et al. | 347/92 |
| 4,376,676 | * | 3/1983 | Gill | 196/46 |
| 5,252,229 | * | 10/1993 | Rojey et al. | 210/787 |
| 5,462,585 | * | 10/1995 | Niskanen et al. | 95/261 |
| 5,531,811 | * | 7/1996 | Kloberdanz | 95/261 |
| 5,902,378 | * | 5/1999 | Obrejanu | 95/248 |
| 6,036,749 | * | 3/2000 | Ribeiro et al. | 95/261 |

* cited by examiner

*Primary Examiner*—N. Le
*Assistant Examiner*—Judy Nguyen
(74) *Attorney, Agent, or Firm*—Barbara Joan Haushalter

(57) ABSTRACT

An ink tank apparatus having a reservoir for containing ink, is improved to control or eliminate the harmful effects of foaming, misting and splatter of ink in the ink tank. A fluid pump delivers ink to a printer system, having an associated reservoir, and a vacuum pump acts on the reservoir to return unused ink from the printer to the reservoir. The returning ink is caused to enter the reservoir at an angle so the returned ink tends to stay near a surface of the reservoir ink level. In particular a ramp or series of ramps are provided along which the returning ink travels. Furthermore, the returned ink is ported into a confined inlet chamber from which the returned ink drains into the ink tank, and the returned ink is ported into this confined inlet chamber so as to produce a vortex-like flow in the inlet chamber. A drain port from the inlet chamber can be restricted to reduce pulsations in the returned flow, and baffles can be used to inhibit the flow of mist to the vacuum port of the ink tank.

9 Claims, 2 Drawing Sheets

FOAMLESS RAMPS FOR CONTROLLING THE FLOW OF INK TO ELIMINATE FOAM IN AN INK TANK

TECHNICAL FIELD

The present invention relates to continuous ink jet printers and, more particularly, to an anti-foaming design of a fluid reservoir of a continuous ink jet printer.

BACKGROUND ART

In continuous ink jet printing, ink from an ink tank is supplied under pressure to a manifold that distributes the ink to a plurality of orifices, typically arranged in linear array(s). The ink is expelled from the orifices in jets which break up due to surface tension in the ink into droplet streams. Ink jet printing is accomplished with these droplet streams by selectively charging and deflecting some droplets from their normal trajectories. The deflected or undeflected droplets are caught and returned to the ink tank, while the others are allowed to impinge on a printing surface.

Ink is returned from the printhead to the ink tank by holding the ink tank under vacuum. As the ink is drawn through the ink return lines from the catcher or the drop generator, air can also be drawn in as well. This ink-air mixture flows through the ink return lines in a combination of plug and surge flow.

If these fluid lines are ported into the top of the ink tank, the ink returning to the tank can splash and spray down on the ink in the tank. This can generate large amounts of foam in the tank. If the foam build up is too large, some of this foam can be sucked out the vacuum port of the tank. This foam can foul up the vacuum pump or the vacuum control system, if allowed to pass through them. To avoid this problem the prior art has employed three strategies. First, one can try to develop low foaming or non-foaming ink. This typically requires the addition of an anti-foaming agent into the ink. It has been found that such chemicals can have a detrimental effect on the ink-paper interaction, hurting print quality and on runnability of the ink jet system. As a result this is not a desirable option. Second, one can place a foam carry over jar in the vacuum line, between the ink tank and the vacuum pump or vacuum control system. This system is still not trouble free. Under some conditions, the foam can fill not only the ink tank but also the carry over jar. This allows the foam to enter the vacuum pump and control system. Even without filling both the ink tank and carry over jar, the foam can be harmful to the vacuum system. When the bubbles at the surface of the foam burst, they send a fine spray of ink mist or droplets into the air. This fine mist can also be drawn into the vacuum pump, causing it damage. The third strategy to deal with foam has been to reduce the amount of foam which is generated.

Since the foam had been produced by the splashing and spraying of ink onto the surface of the ink, the prior art attempted to port the ink return lines into the ink tank below the surface of the ink in the tank. As the return lines also carry air in, along with the ink, numerous large bubbles are formed as the air enters the tank. As a result a large amount of foam is produced by the this porting option as well.

Another prior art option, has been to port the return lines into the fluid tank above the ink level, but aim the fluid ports directly at the tank walls. The fluid then flows down the tank walls. This greatly reduces the amount of foam produced. While beneficial, this option is not sufficient.

The rapidly moving layer of ink flowing down the tank walls, which results from directing the fluid flow at the walls, enters the bulk fluid in the tank at high velocity. This can cause air to be dragged or entrained down into the bulk of the ink. The entrained air bubbles in the ink can be drawn into the ink pump that is ported out of the bottom of the tank. Such air in the ink pumped to the printhead can adversely affect the operation of the ink jet printer.

An addition failing of this prior art design of directing the returning fluid ports is the result of the non-uniform flow out of these ports. The two phase (ink and air) flow in the return tubes tends to be a combination of plug and surge flow. As a result of the plug and surge flow in the return lines, some foam and a spray of mist can be produced as the ink-air mixture exits the fluid port and splashes into the walls of the tank. This can still produce the vacuum system errors found in the earlier prior art.

It is seen that there exists a need for better means for controlling or eliminating the harmful effects of foam in the ink tank without the need for chemical defoamers and without the problem of air bubbles being entrained into the bulk fluid by the rapid flow of ink down the tank walls.

SUMMARY OF THE INVENTION

It is the object of the present invention to provide a foamless ink tank which eliminates foaming in the ink tank. This allows ink formulators to formulate ink without having to include defoaming chemicals in the ink composition. The present invention therefore results in improved print capability and fewer problems with crooked jets. Furthermore, eliminating the ink maintains the controls, pumps and filters in better print quality condition. Finally, the foamless ink tank design of the present invention allows for a smaller ink tank since there is no need to allow excess room for the foam to collect.

In accordance with one aspect of the present invention, an ink tank apparatus having a reservoir for containing ink, is improved to control or eliminate the harmful effects of foaming, misting and splatter of ink in the ink tank. A fluid pump delivers ink to a printer system, having an associated reservoir, and a vacuum means acts on the reservoir to return unused ink from the printer to the reservoir. The returning ink is caused to enter the reservoir at an angle so the returned ink tends to stay near a surface of the reservoir ink level. In particular a ramp or series of ramps are provided along which the returning ink travels. Furthermore, the returned ink is ported into a confined inlet chamber from which the returned ink drains into the ink tank, and the returned ink is ported into this confined inlet chamber so as to produce a vortex-like flow in the inlet chamber. A drain port from the inlet chamber can be restricted to reduce pulsations in the returned flow, and baffles can be used to inhibit the flow of mist to the vacuum port of the ink tank.

Other objects and advantages of the invention will be apparent from the following description and the appended claims.

DETAILED DESCRIPTION OF THE INVENTION

The present invention proposes a technique for preventing ink dissemination, such as ink foam, mist, and spray, from entering the vacuum, and further to prevent entrained air from entering the fluid pump. In accordance with the present invention, ink from an ink tank or reservoir is pumped by an ink pump to a printhead and uses vacuum on the reservoir to return the unused ink from the printhead to the reservoir. The tank is constructed to minimize or prevent the harmful effects of foaming of the ink in the reservoir by employing one or more mist barriers, ink ramps, submerged ink ramps, and a tubular ink inlet that reduces ink velocity.

It was seen in the prior art, that causing the return fluid to flow down the wall the ink tank produced less foam than allowing the ink to flow, spray or splash down on the surface of the ink in the tank. The rapid flow of fluid down the wall of the tank, however, provided the ink with too much vertical momentum as it entered the bulk fluid. As a result, air tended to get entrained and drawn down into the bulk fluid.

Figure 1:
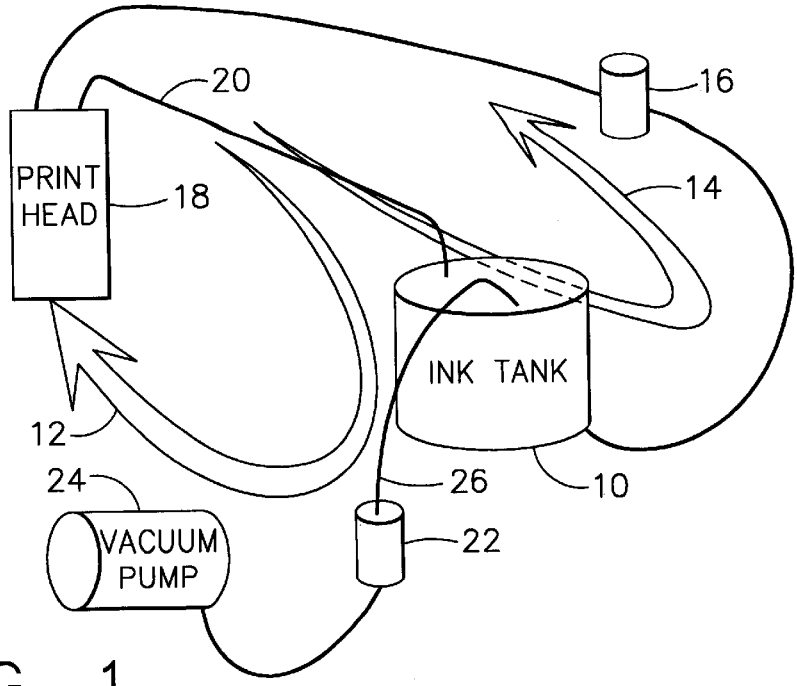
FIG. 1 is a block diagram illustrating the interrelationship between components of a continuous ink jet printer.

The interrelationship between components associated with ink tank 10 can be seen in FIG. 1. One problem with the current art is that bubbles in ink tank 10 send mist and splatter into the air when they burst, with air flow in the direction of arrow 12 and ink flow in the direction of arrow 14. The ink tank 10 has an associated ink pump 16, and provides ink to and receives ink from a printhead 18. Small bubbles break up violently when leaving the end of inlet tube 20 entering the tank 10. This causes an air borne mist that travels through vacuum solenoid 22 and into vacuum pump 24. In addition, with the prior art, large bubbles can form inside tank 10 and lay on the ink surface. When these large bubbles break, large droplets are sent across the tank 10 and generate a fine mist which may get sucked out of vacuum line 26.

Bubbles, mist and splattering can also be caused by the impact of high velocity ink jet entering tank 10, and the impact of high velocity air entering the ink tank 10. With prior art configurations, high velocity exit air to the vacuum pump 24 sucks mist and splatter out of the tank 10, to a carry over jar (not shown) through the vacuum servo 22.

Figure 2:
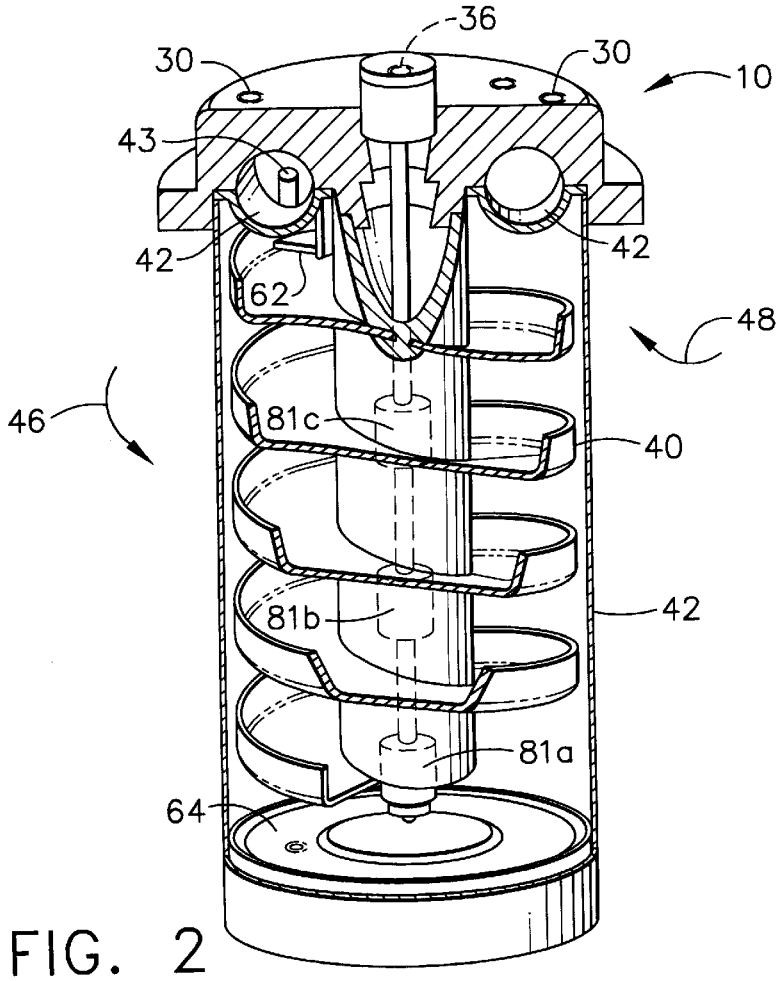
FIG. 2 is a cutaway view of the ink tank of FIG. 1, constructed in accordance with the present invention.

In accordance with the present invention, ink disturbance problems are eliminated by introducing certain novel structural features to the ink tank. The present invention proposes an ink tank constructed to prevent the formation of bubbles, foam, mist, and splatter associated with ink tanks in the existing art. The ink tank 10 illustrated in FIG. 2 is constructed in accordance with the teachings of the present invention. The present invention proposes several novel features which can be applied individually or simultaneously to eliminate or reduce the adverse effects of foaming in the ink tank of an ink jet printhead.

Prior art ink tanks reduced the generation of foam by directing the returning ink flow down the walls of the ink tank. While an effective foam reducer, this resulted in air being entrained down into the ink tank produced by the large vertical velocity of the fluid down the wall into the bulk ink. To maintain the foam reducing benefit of flow down the wall without the disadvantage of the air entrainment, the present invention causes the fluid to flow down a ramp 40 into the bulk fluid. The normal reservoir ink level in the tank is at the middle float switch 81*b* which is shown in the center of the tank. The ink tank employs three float switches 81*a*, 81*b*, and 81*c*, shown in FIG. 2. These float switches are mounted on a shaft installed in the tank by means of port 39, in FIG. 3B. The trip point for the lower float switch 81a is used to detect dangerously low ink levels. The refilling of the ink tank with make-up fluids to replace ink used for printing or due to evaporation is controlled by the middle float switch 81*b*. The upper float switch 81*c* is used to detect dangerously high ink levels. The slope of the ramp greatly reduces the velocity of the fluid as it enters the bulk ink. With the reduced vertical flow, the returned flow tends to flow across the surface of the fluid in the ink tank rather than down into it. In this way, the problem of air being entrained into the ink, from which entrained air bubbles in the ink can be drawn into the ink pump via port 64 at the bottom of the tank, is eliminated.

Figure 3A:
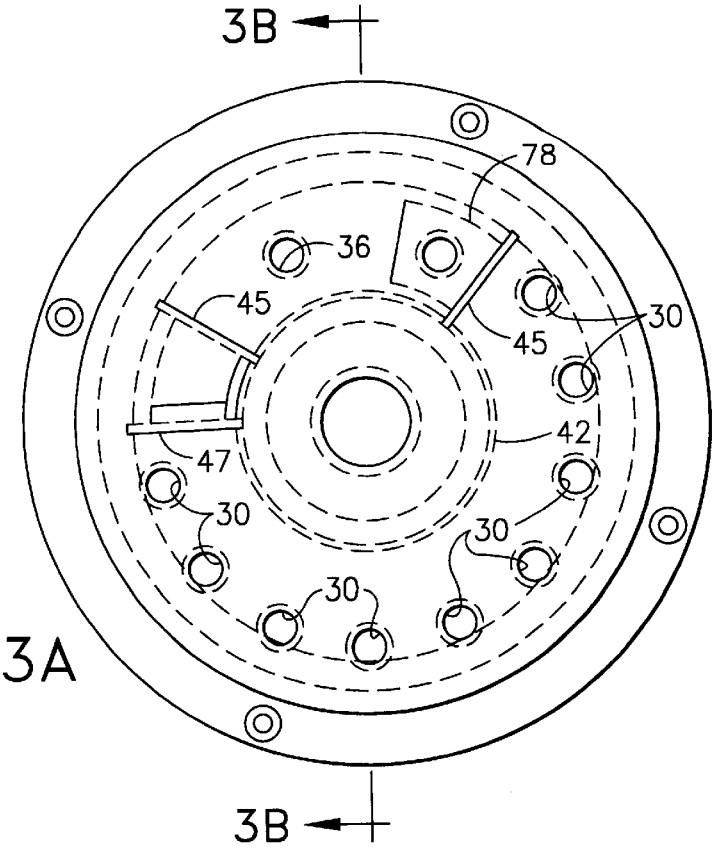
FIGS. 3A and 3B are top and side cutaway views, respectively, of an inlet portion of the ink tank of FIG. 2.
Figure 3B:
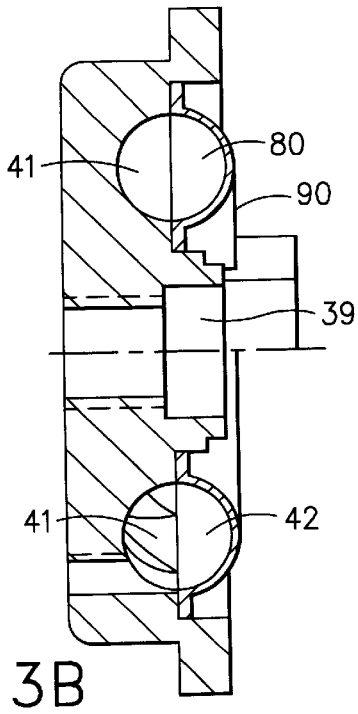

The prior art produced a lot of spray and splash as the ink entered the ink tank. This was produced by the plug and surge flow in the return fluid lines. The splashing and spraying of the prior art tended to produce mist which was detrimental to the vacuum system. The present invention deals with this problem by improving the design of entrance port 30 to the tank. Rather than port the return lines 20 directly to the tank, the return lines open into an inlet chamber 42 which is small compared to the tank but still significantly larger than the cross section of the return lines 30. This entrance chamber 42 is shown in FIGS. 2, 3A and 3B. In a preferred embodiment, this entrance chamber resembles a portion of a donut-shaped volume 41 in the top of the ink tank. Fluid enters this volume through a number of ink return ports 30 as seen in FIG. 3A, with a port 39 for a float switch illustrated in FIG. 3B. The fluid exits this chamber 42 through a restricted exit port 43 shown in FIG. 2. The wall 4, which contains this restricted exit is shown in FIG. 3A. Another section of this donut shaped volume 41 in the top of the tank forms an exit chamber 80 associated with the vacuum port of the tank.

This entrance chamber 42 acts as an impulse reducer. Much like an automobile muffler helps to dissipate impulses from the engine by enlarging the diameter of the exhaust line and by also providing some restriction to flow, the entrance chamber helps to reduce the impulses from the ink return lines by providing an enlarged volume and having a restricted exit. As slugs of air, mixed with the ink enter this entrance chamber they expand into the volume of the entrance chamber. The restriction of the exit from this chamber serves to reflect some of the pressure pulse produced by this expanding air back into the entrance volume. In this way the impulses from the returning flow are effectively dissipated in the entrance chamber.

The chamber 42 is designed to be roughly circular in cross section. The ink return ports 30 are not centered over the entrance chamber, but rather direct the incoming fluid down the wall. In this way the fluid tends to stay attached to the wall, rather than spattering into it. The incoming flow also tends to set up a vortex inside the inlet chamber. The vortex also aids in separating the ink and air flows. Any splatter and mist produced by ink entering this chamber is tends to be confined in the entrance chamber, minimizing the risk of the spray entering the vacuum system.

Fluid leaves the inlet chamber through the restricted exit located in wall 47 of FIG. 3A. This restricted exit 43, shown in FIG. 2 is in the shape of a vertically elongated port. The ink which has separated from the air, flows out through the bottom of restricted exit 47 in FIG. 3A, while air can flow out through the upper portion at restricted exit 43 in FIG. 2, without being remixed with the ink. The ink exiting from the restricted exit of the inlet chamber is directed at adjacent surface 62, from which it begins flowing down the ramp 40 to the level of the ink. As shown in FIG. 2, the flow in the inlet chamber is clockwise, as indicated by arrow 48. The slope of the ramp is such that the fluid descends the ramp in a counter-clockwise direction, as indicated by arrow 46. This reversal of the flow direction as the fluid exits the chamber through the restricted exit and strikes the adjacent surface 62 helps to slow the flow of ink down the ramp.

In addition to minimizing the formation of foam, and the splatter of ink entering the ink tank, the present invention also protects the vacuum system by preventing airborne mist or spray from being drawn into the vacuum port 36. This is done in part by using some of the donut shaped volume 41 at the top of the tank as an exit chamber for the ink tank as indicated in FIG. 3B. This exit chamber 80 is the section of the donut-shaped volume 41 between the two walls 45 shown in FIG. 3A. Air, exiting the ink tank through the vacuum port 36, enters this exit chamber 80 through an opening or port 78, shown in FIG. 3A in the bottom wall of this chamber. The air pass must then through exit chamber to reach the vacuum port 36. In this way both the end walls 45 and the bottom wall 90 exit chamber serve as baffles to produce a circuitous pass for the air flow leaving the ink tank. While the air can make the turns with ease, the heavier mist tends to strike the walls, from which it can flow back down to the level of ink in the tank. Similarly, the ramps 40 down which the ink flows also serve as baffles 40 for the air flow in the tank to impede mist from reaching the vacuum port. As will be obvious to those skilled in the art, other or additional mist barriers can be employed to enhance the advantages provided thereby.

The invention has been described in detail with particular reference to certain preferred embodiments thereof, but it will be understood that modifications and variations can be effected within the spirit and scope of the invention.

What is claimed is:

1. An ink tank apparatus having an ink tank for containing ink, the ink tank apparatus comprising:

a fluid pump to deliver ink to a printhead, the printhead selectively charging and deflecting drops from normal trajectory, allowing some drops to print and other drops to be recirculated as unused ink;

a vacuum means acting on the ink tank to return unused ink from the printhead to the ink tank;

ink disturbance prevention means for eliminating disturbance in the ink tank, wherein the ink disturbance prevention means comprises an impulse reducer and angled fluid paths configured to allow the unused ink to flow in the ink tank through the impulse reducer in a first direction and through angled fluid paths in a second direction opposite from the first direction.

2. An ink tank apparatus as claimed in claim 1 wherein the impulse reducer comprises an inlet chamber.

3. An ink tank apparatus as claimed in claim 2 wherein the inlet chamber is approximately circular in cross section.

4. An ink tank apparatus as claimed in claim 1 wherein the angled fluid paths comprise submerged ink ramps.

5. An ink tank apparatus as claimed in claim 1 wherein the ink disturbance prevention means prevent incidental splatter and mist from reaching the vacuum means.

6. An ink tank apparatus having an ink tank for containing ink, the ink tank apparatus comprising:

a fluid pump to deliver ink to a printhead, the printhead selectively charging and deflecting drops from normal trajectory, allowing some drops to print and other drops to be recirculated as unused ink;

a vacuum means acting on the ink tank to return unused ink from the printhead to the ink tank;

means for causing the unused ink to enter the ink tank in a first direction and a second direction opposite from the first direction, wherein the ink flows in said second direction at an angle so the unused ink tends to stay near a surface of the ink tank.

7. An ink tank apparatus as claimed in claim 6, wherein the means for causing the unused ink to enter the ink tank comprises ramps along which the unused ink travels at said angle.

8. An ink tank apparatus as claimed in claim 6, wherein said means for causing the unused ink to enter the ink tank comprises an inlet chamber into which the unused ink flows in the first direction, said inlet chamber has a drain port to reduce flow of the unused ink.

9. An ink tank apparatus as claimed in claim 8 wherein the means for causing the unused ink to enter the ink tank in the first and second directions inhibits flow of mist to said vacuum means.

* * * * *